US006746006B2

(12) United States Patent
Thomas

(10) Patent No.: US 6,746,006 B2
(45) Date of Patent: Jun. 8, 2004

(54) COMPRESSION AND EXPANSION TOOL

(76) Inventor: Lowell Thomas, 27980 Norris Rd., Bozeman, MT (US) 59715

( * ) Notice: Subject to any disclaimer, the term of this patent is extended or adjusted under 35 U.S.C. 154(b) by 161 days.

(21) Appl. No.: 10/059,123

(22) Filed: Jan. 31, 2002

(65) Prior Publication Data

US 2003/0141644 A1 Jul. 31, 2003

(51) Int. Cl.[7] ..... B25B 1/00
(52) U.S. Cl. ..... 269/6; 269/170; 269/3; 269/166
(58) Field of Search ..... 269/6, 170, 3, 269/166, 168, 169, 203, 204; 81/487

(56) References Cited

U.S. PATENT DOCUMENTS 4,893,801 A 1/1990 Flinn
5,005,449 A 4/1991 Sorensen et al.
5,009,134 A 4/1991 Sorensen et al.
5,170,682 A 12/1992 Sorensen et al.
5,217,213 A * 6/1993 Lii ..... 269/6
5,222,420 A 6/1993 Sorensen et al.
5,454,551 A * 10/1995 Hobday ..... 269/6
5,826,310 A * 10/1998 Hobday ..... 24/514
6,412,767 B1 * 7/2002 Beckmann et al. ..... 269/166

* cited by examiner

*Primary Examiner*—Joseph J. Hail, III
*Assistant Examiner*—Daniel Shanley
(74) *Attorney, Agent, or Firm*—Shlesinger, Arkwright & Garvey LLP

(57) ABSTRACT

A tool for selectively compressing and expanding work, the tool comprising a handle including bar holders and at least two slidable bars having work engaging surfaces at ends thereof both of which are slidably received in a separate one of the bar holders and both being adapted to be selectively fixed therein whereby at least one of the slidable bars is adapted to be reversibly received in one of the bar holders of the handle.

18 Claims, 7 Drawing Sheets

COMPRESSION AND EXPANSION TOOL

FIELD OF THE INVENTION

This invention relates to tools and in particular a tool having a slidable bar adapted to allow the tool to function as both a clamp and a spreader jack.

BACKGROUND OF THE INVENTION

Hand tools adapted to clamp, grip or otherwise hold together pieces of wood, steel, or other materials for temporary or permanent connection are known.

Prior art C clamps have many disadvantages. Prior art C clamps often employ a screw mechanism to generate the clamping forces. Such devices are slow and require both hands to operate. They also have limited displacement which in turn limits the size and shape of the workpiece which can be clamped. While it is know to simply increase the size of a clamp to adapt it to fit a larger workpiece, such clamps are heavy and difficult to maneuver. Further, such prior art clamps are not readily adapted to be used as a spreader jack nor do such clamps permit clamping at the inside apex angle of the workpiece.

Prior art clamps are also limited in that the maximum span of the clamp is often fixed and limited and the trigger mechanism which advances one of the jaw bars is not reversible and/or is difficult to reassemble following disassembly.

Each of U.S. Pat. No. 4,893,801 to Flinn; U.S. Pat. No. 5,005,449 to Sorensen et al.; U.S. Pat. No. 5,009,134 to Sorensen et al.; U.S. Pat. No. 5,170,682 to Sorensen et al. and U.S. Pat. No. 5,222,420 to Sorensen et al. disclose hand held clamps having a fixed jaw secured to a hand grip and a movable jaw secured to one end of a single slidable bar member adapted to extend through the hand grip. Sorensen et al. '682 discloses a tool having the capacity to readily convert from a clamp to a spreader jack; however, in order to reverse the face of the movable jaw a force in excess of 200 pounds must be applied to the pins in order to facilitate removal. Further, the use of a coil spring in the trigger mechanism of the handle/bar holder will cause the gripping plate and other elements in the trigger mechanism to fall out of alignment as the bar is withdrawn from the handle and necessarily renders reassembly difficult. U.S. Pat. No. 5,009,134 to Sorensen et al. also mandates the removal and reversal of one of the jaws in order to adapt the device for use as a spreader jack. The hand held clamp of Flinn discloses two parallel bars, however one of the bars is fixed.

OBJECT AND SUMMARY OF THE INVENTION

It is an object of this invention to provide a tool adapted to be easily converted so as to function as a clamp or as a spreader jack.

Another object is to provide a trigger mechanism for a tool handle that may be rotated 180 degrees to adapt the tool for purposes of offset jacking, for example, when jacking a double hung window.

A further object is to provide a tool where the at least two slidable bars are adapted to provide a so-called C clamp (FIG. 5) having a greatly expanded capacity to receive the workpiece to be clamped; namely, the entire lengths of each of the slidable bars are separately and adjustably received within the bar holder to thereby increase clamping displacement or volume and/or allow clamping of unusual shapes such as an L or T shaped workpiece and where the clamping force must be applied near the inside apex of the workpiece angle and/or the clamp must reach past an intervening leg of the workpiece angle.

Another object is to provide a tool having an improved handle mechanism so that the slidable bars received in the handles may readily be reversed without the need to apply a great deal of force and effort as is required during reversal of the prior art devices and further, will not result in the various individual trigger mechanism elements falling apart as is the case in the prior art devices.

Another object of this invention is to provide a tool having both expansion and compression capability without the need for removal and reversal of a jaw member.

Another object of the present invention is to provide a tool adapted to permit removal of one of the bars yet still allow the tool to function as a clamp or spreader jack.

A further object of this invention is to provide an adjustable tool readily adapted to receive one or more pieces of work material.

Still a further object of this invention is to provide a tool having sufficient clearance for grasping the work at different points or locations.

A further object of this invention is to provide a work tool having four separate jaws.

A still further object of the invention is to provide a tool having a readily reversible feature due to the use of a leaf spring in the trigger mechanism that allows the slidable bars to be easily removed from the handle and reversed without the need for tools and without causing the trigger mechanism parts to become displace and therefore difficult to reassemble as is the case with the prior art devices.

Another object of the invention is to provide a tool having a trigger mechanism in the handle which includes a leaf spring adapted to remain in a working position during disassembly of the trigger mechanism due to the provision of a curved surface at one end of the leaf spring which retains the gripping plate in place.

Still another object of the present invention is to provide a tool having a auxiliary jaw to enable the device to operate as a true C clamp and thereby permit clamping beyond flanges or other obstructions.

In addition, the present device provides a tool having a slidable bar, one end of which includes a standing jaw-comprising a pair of opposed face plates at one end thereof so that the tool according to the present invention may be readily converted from a clamp and into a spreader jack.

In summary, the present invention relates to a work tool for clamping, expanding and/or pushing away of the work material, either temporarily or permanently.

These and other objects will be apparent from the following description and the drawings which are described as follows.

DETAILED DESCRIPTION OF THE PREFERRED EMBODIMENTS

Figure 1:
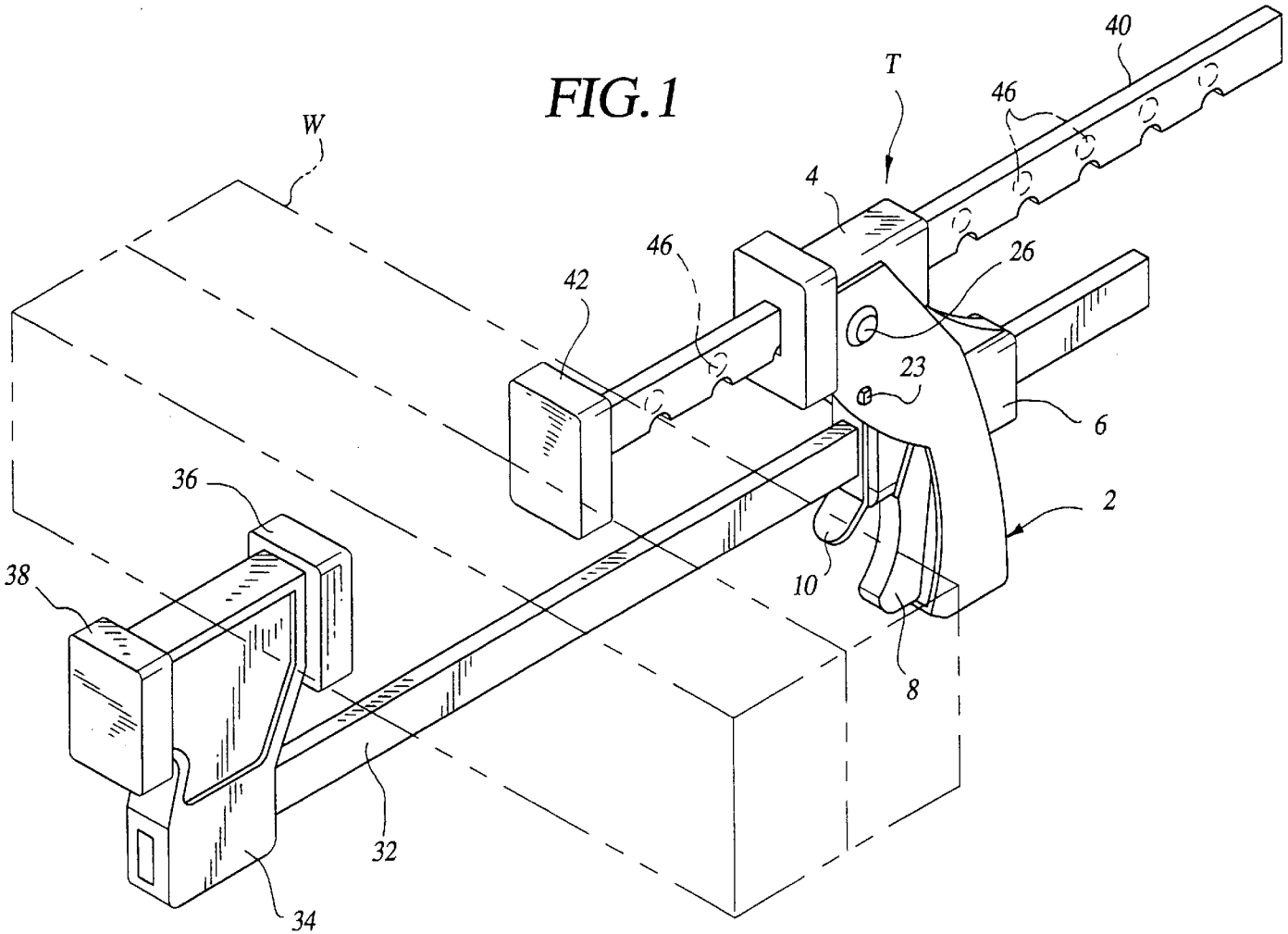
FIG. 1 is a perspective view of the work tool according to the present invention when in a compression position and showing the work and pin holes in phantom lines.

Each of the figures illustrate the work tool T according to the present invention. The tool T includes a handle 2 having an upper bar holder 4 and a lower bar holder 6 each of which are adapted to adjustably receive a separate bar which will be further described below. The handle 2 is provided with a trigger 8 and a release trigger mechanism 10.

Figures 3, 3A:
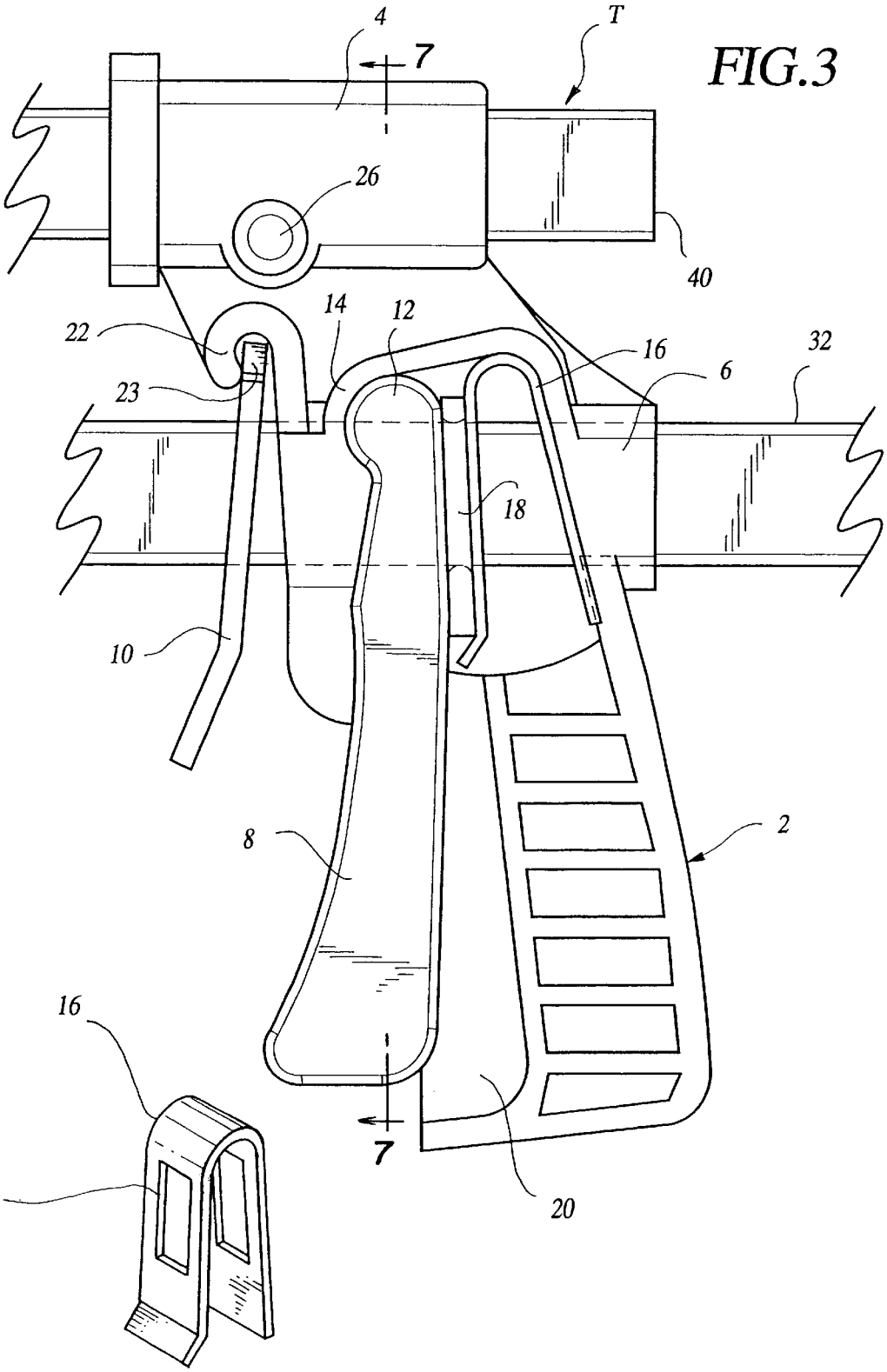
FIG. 3 is an enlarged, fragmentary side elevation view of the work tool with the trigger mechanism in a release position.
FIG. 3A is a perspective view of the U-shaped spring shown in FIG. 3.
Figure 4:
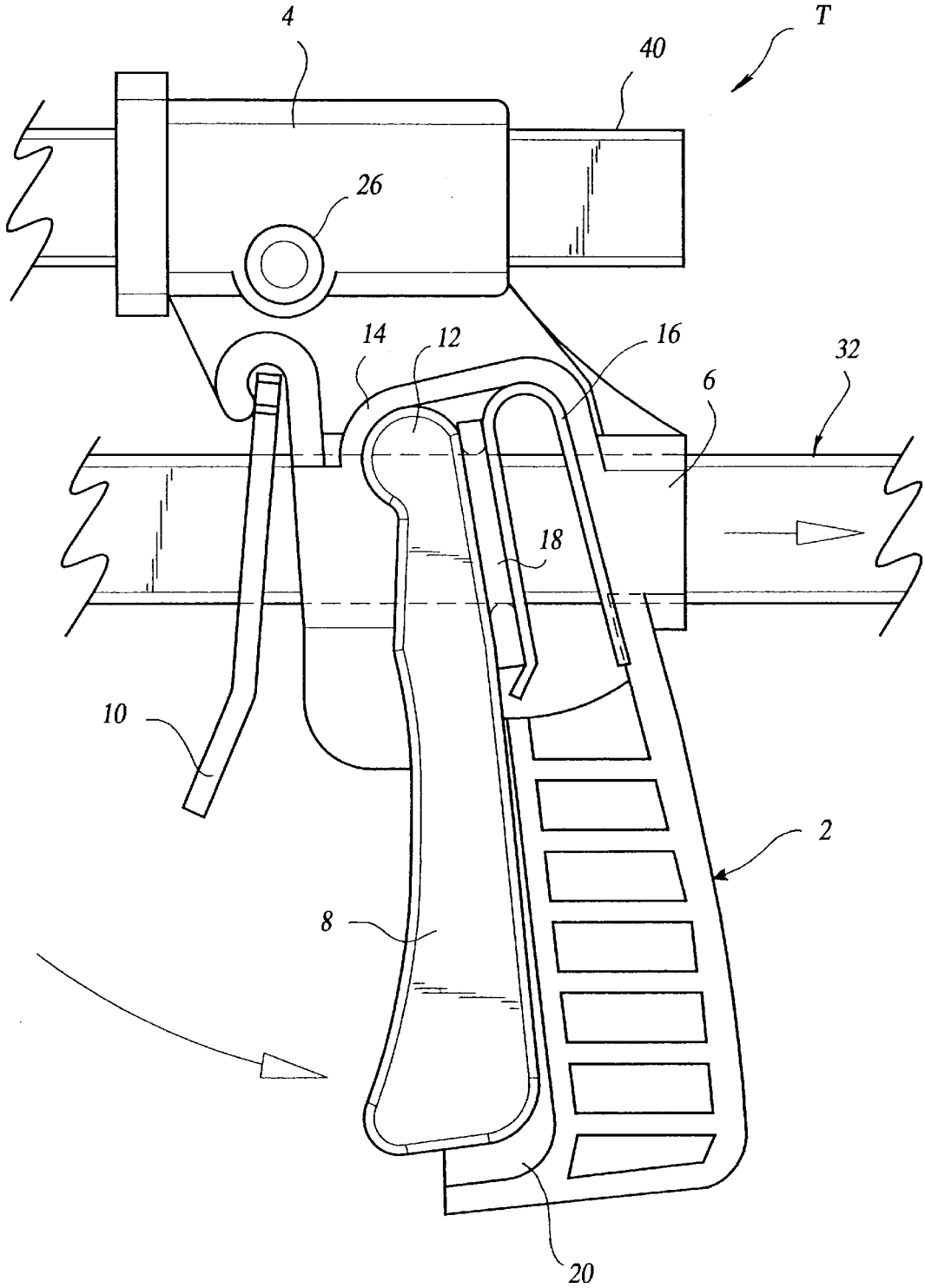
FIG. 4 is an enlarged, fragmentary side elevation view of the work tool shown in FIG. 3 with the trigger in the activation position.
Figure 7:
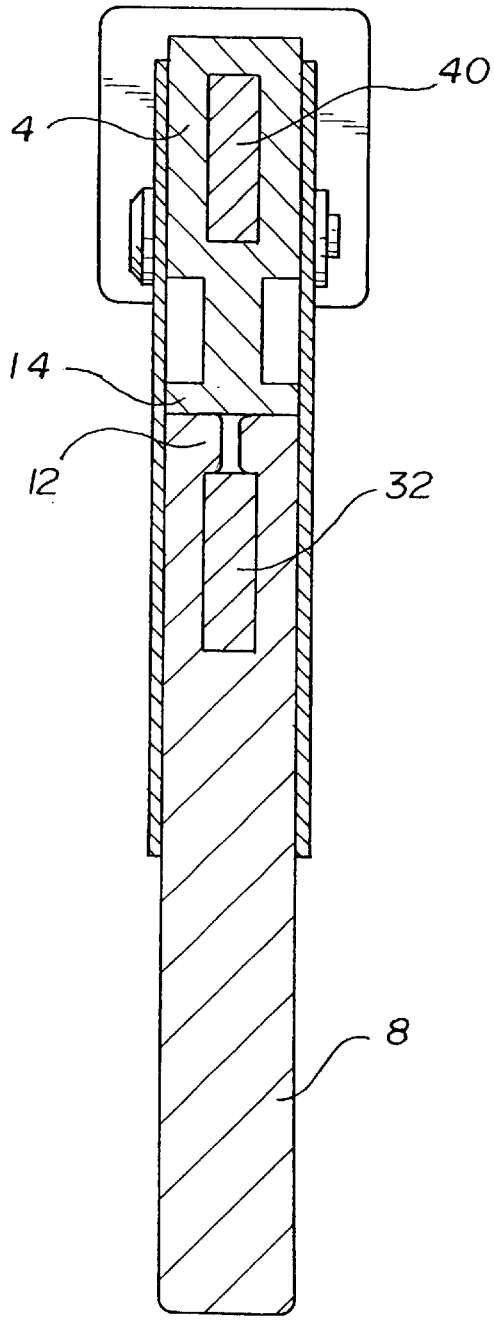
FIG. 7 is a sectional view taken along lines 7—7 in FIG. 3.

As best shown in each of FIGS. 3, 4 and 7, the trigger 8 is provided with a pivot portion 12 adapted to pivot in housing 14 of the handle 2. Within the housing 14 is provided a U-shaped spring 16. Spring 16 is best shown in FIG. 3A. Spring 16 is shown to be biased against a gripping plate 18 positioned between spring 16 and the trigger 8. As can be seen in each of FIGS. 3 and 4, the trigger 8 operates and is moveable in recess 20 of handle 2. FIG. 3 shows the trigger 8 in a forward position prior to actuation. FIG. 4 shows the trigger 8 during operation or in the actuated position. The trigger 8 is shown to be snap fit into the housing 14 and is of a yoke or design fixing around lower bar holder 6. As is apparent, a spring design other than that as shown in the drawings is within the scope of the present invention so long as the trigger 8 functions in the manner as described below. Further, an actuation device other than a spring is within the scope of the present invention so long as the actuation device selected permits the device to operate in the manner described below.

The housing 14, as best shown in FIGS. 3 and 4, includes the release trigger mechanism 10 which pivots in the hook portion 22 of the housing 14 and is secured by a pivot pin 23. The release trigger mechanism 10 is best shown in FIG. 6 and includes a window opening 24.

Figure 6:
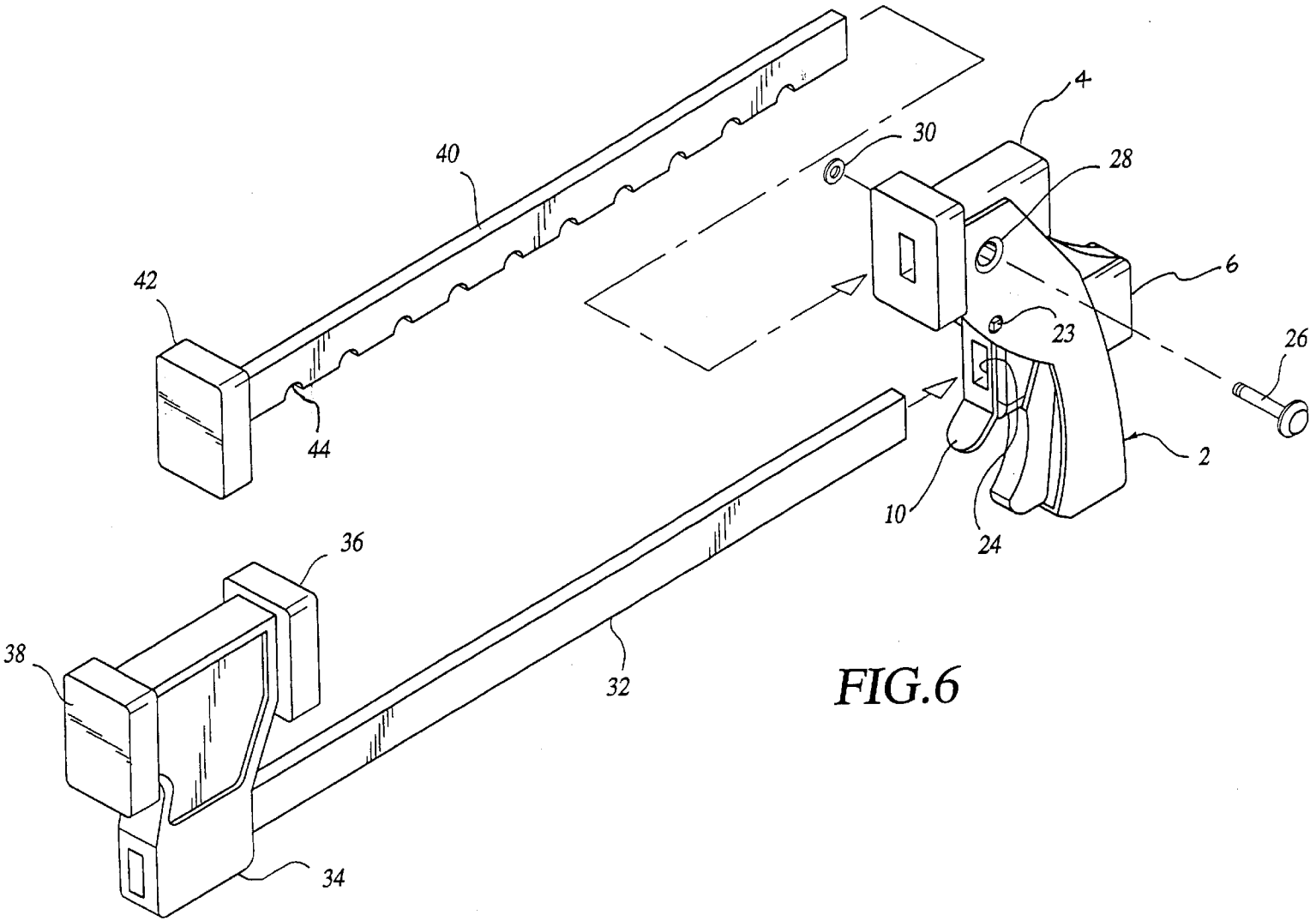
FIG. 6 is an exploded, perspective view of the work tool shown in FIG. 5.

Turning to FIG. 6, a lock pin 26 is shown to extend through an opening 28 in the handle 2 and is secured by a nut or lock washer 30. Lower bar 32 includes work a engaging device 34 having an expansion or face plate 36 and a compression or face plate 38 and is adapted to be slidingly received in lower bar holder 6 and through window 24 of the release trigger mechanism 10. Upper bar 40 is adapted to be slidingly received in upper bar holder 4 and includes face plate 42 which may be used for compression and/or expansion work. A locking pin 26 is adapted to selectively engage lock positioning notches 44 of upper bar 40. It is understood that instead of notches 44, pin holes 46 (FIG. 1) may be substituted on upper bar 40 to lock or otherwise fix the position of upper bar 40 within bar holder 4. If pin holes 46 are used, the pin 26 is mounted in handle 2 so as to align with pin holes 46.

As is apparent, the device as set forth above may be constructed from a variety of materials depending upon design considerations. In particular, the clamping or jacking forces of the device are directly related to the nature of the construction materials used. For example, the use of high strength steels will yield a tool having high durability and strength and which is readily adapted to hold or spread heavy metal object whereas the use of plastic materials will provide a tool having light weight for ease of handling and which may be readily adapted for use with wooden or plastic work materials. In the alternative, a combination of different materials may be used. For example, the upper and lower bars as well as the spring may be constructed from steel or other another metal material for purposes of durability and strength whereas the remaining parts may be constructed from injection molded reinforced plastic to reduce the weight of the device and overall manufacturing costs.

Figure 2:
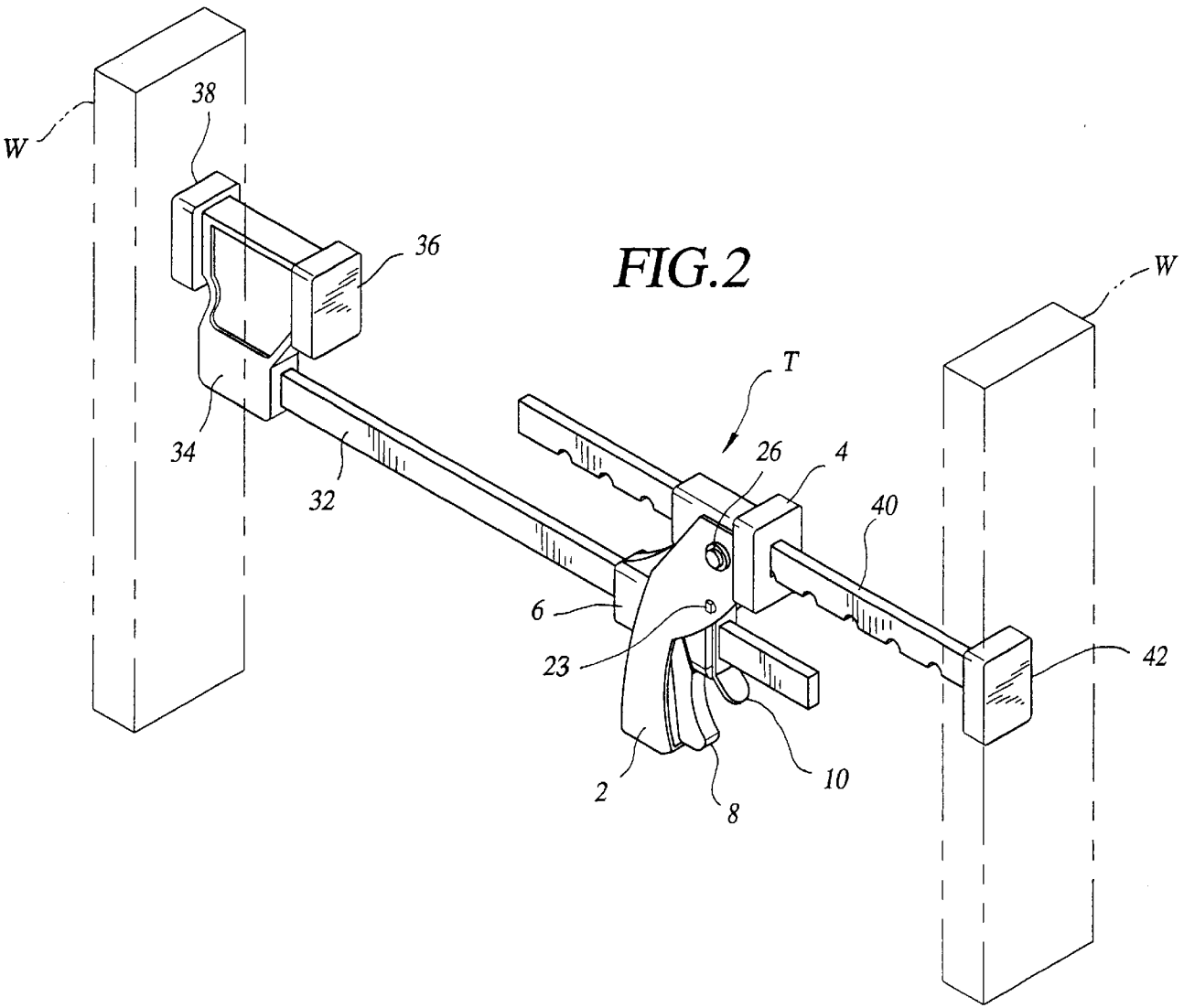
FIG. 2 is a perspective view of the work tool according to the present invention when in the expansion position and showing the work shown in phantom lines.
Figure 5:
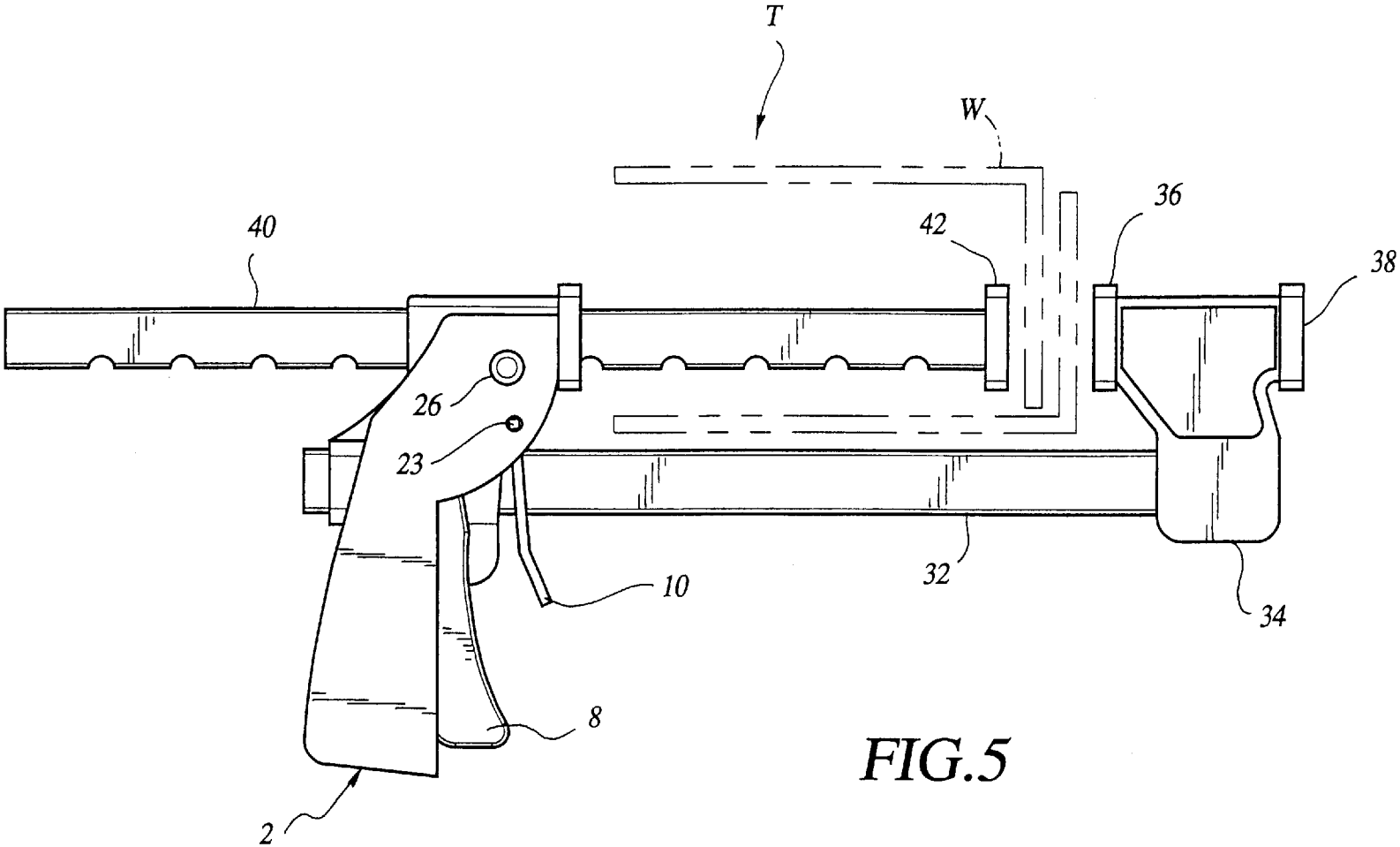
FIG. 5 is a side elevation view of a work tool according to the present invention and with the work shown in phantom lines.

The tool according to the present invention operates in the following manner. When the trigger 8 is actuated, the gripping plate 18 moves to the right, from a position shown in FIG. 3 to the position shown in FIG. 4, compressing spring 16 and thereby causing the bar 32 to move incrementally in the direction of the arrow on bar 32 as best seen in FIG. 4. Release of the trigger 8 will set the trigger 8 in position for another incremental move permitting the bar 32 to be moved in relation to the bar 40. Bar 40 is initially positioned by sliding the bar 40 in the bar holder 4 and then locking in position with the pin 26 engaging a notch 44 or hole 46 to lock the bar 40 in position relative to the bar 32. Depending upon the position of the bars 32 and 40 in the handle 2, the face plates 36 and 42 will face each other for clamping the work W as shown in each of FIGS. 1 and 5. The work engaging device 34 with the face 38 when positioned for expansion, as shown in FIG. 2, is reversed in the handle 2 so that it will operate in the expansion mode for engaging with the work W. The work engaging device 34 is fixed on the bar 32 and need not be removed therefrom in order to use it as expansion or compression mechanism. Only bar 32 need be removed and reversed in the handle 2 for selectively adapting the device for either compression or expansion mode. Release trigger 10 is designed to lock bar 32 from movement in the direction opposite to the movement of the bar 32 when actuated by trigger 8. When the release trigger mechanism 10 is operated, the bar 32 can be slipped in lower bar holder 6 for rapid initial adjustment.

While this invention has been described as having a preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A compression and expansions work tool comprising:

a) a handle;

b) said handle having a pair of spaced apart slidable bar holders;

c) a slidable bar supported in each of said a pair of spaced apart slidable bar holders;

d) a trigger mounted on said handle for moving at least one of said slidable bars;

e) each of said slidable bars having a work engaging device whereby when said trigger is actuated said at least one of said slidable bars will move at least one of said work engaging devices to apply a compression or expansion force on a workpiece in contact with said work engaging device;

f) said other of said slidable bars has a plurality of notches along its length; and g) said handle has a movable pin for engaging said notches to limit the movement of said at least one slidable bar.

2. A compression and expansion work tool as in claim 1, wherein:

a) said trigger including a spring mechanism operatively associated with said handle.

3. A compression and expansion work tool as in claim 1, wherein:

a) said handle includes a brake lever mechanism.

4. A compression and expansion work tool as in claim 1, wherein:

a) said pair of spaced apart slidable bars have vertical face plates; and b) said at least one said of slidable bars has combined vertical expansion and compression face plates.

5. A compression and expansion work tool as in claim 1, and further including:

a) a gripping plate, said at least one of said slidable bars is operated by said gripping plate.

6. A compression and expansion work tool as in claim 1 and further including:

a) a release trigger mechanism, said release trigger mechanism is associated with said handle.

7. A compression and expansion work tool as in claim 1, wherein:

a) said at least one of said slidable bars is operably associated with a locking mechanism and said handle has a cooperating device for securing said locking mechanism.

8. A compression and expansion work tool as in claim 7 and wherein:

a) said locking mechanism includes holes, and b) said cooperating device for securing said locking mechanism is a lock pin.

9. A compression and expansion work tool as in claim 6, wherein:

a) said release trigger is in front of said trigger.

10. A compression and expansion work tool comprising:

a) a handle, said handle adapted to slidably receive and support at least two bar members;

b) a first bar member, said first bar member movably received in said handle;

c) a second bar member, said second bar member movably received in said handle and spaced from said first bar member in a parallel manner;

d) a trigger mechanism, said trigger mechanism operatively associated with said handle for selectively moving one of said first and second bar members;

e) a locking mechanism, said locking mechanism operatively associated with the other of said first and second bar members to lock the same in a fixed position;

f) each of said first and second bar members provided with a work engaging member whereby actuation of said trigger mechanism will cause said one of said first and second bar members to be moved relative to said other of said first and second bars members to thereby generate at least one of compression or expansion forces on a workpiece in contact with said work engaging members of said tool;

g) said other of said first and second bar members provided with a plurality of notches along its length thereof; and h) said handle including a movable pin for engaging at least one of said plurality of notches to limit the movement of said other of said first and second bar members.

11. A compression and expansion work tool as in claim 10 and wherein:

a) said trigger mechanism including a spring mechanism operatively associated with said handle.

12. A compression and expansion work tool as in claim 10, wherein:

a) said handle including a brake lever mechanism.

13. A compression and expansion work tool as in claim 10, wherein:

a) each of said first and second bar members provided with vertically extending face plates; and b) at least one said first and second bar members provided with combined vertical expansion and compression face plates.

14. A compression and expansion work tool as in claim 10, and further including:

a) a gripping plate, said one of said first and second bar members is operatively associated with said gripping plate.

15. A compression and expansion work tool as in claim 10 and further including:

a) a release trigger mechanism, said release trigger mechanism is operatively associated with said handle.

16. A compression and expansion work tool as in claim 10, wherein:

a) said handle has a cooperating device for securing said locking mechanism.

17. A compression and expansion work tool as in claim 16 and wherein:

a) said locking mechanism including apertures, and b) said cooperating device for securing said locking mechanism is a lock pin member.

18. A compression and expansions work tool comprising:

a) a handle;

b) means for holding a pair of spaced apart slidable bars, said holding means operatively associated with said handle;

c) a pair of slidable bars, said pair of slidable bars supported by said holding means;

d) means for moving at least one of said slidable bars, said means operatively associated with said handle;

e) each of said slidable bars having a work engaging device whereby when said moving means is actuated said at least one of said pair of slidable bars will move said work engaging device associated therewith to apply at least one of compression or expansion forces on a workplace;

f) said pair of slidable bars has a plurality of notches along the length thereof; and g) said handle has a movable pin for engaging said notches to limit the movement of said pair of slidable bars.

* * * * *